US005255003A

United States Patent [19]

Mitchell et al.

[11] Patent Number: 5,255,003

[45] Date of Patent: * Oct. 19, 1993

[54] MULTIPLE-FREQUENCY MICROWAVE FEED ASSEMBLY

[75] Inventors: Rodney A. Mitchell, Tujunga; Gerry B. Blachley, Simi Valley, both of Calif.

[73] Assignee: Antenna Downlink, inc., Simi Valley, Calif.

[ * ] Notice: The portion of the term of this patent subsequent to Feb. 20, 2007 has been disclaimed.

[21] Appl. No.: 854,548

[22] Filed: Mar. 19, 1992

Related U.S. Application Data

[63] Continuation-in-part of Ser. No. 405,548, Sep. 11, 1989, Pat. No. 5,107,274, which is a continuation of Ser. No. 105,135, Oct. 2, 1987, Pat. No. 4,903,037.

[51] Int. Cl.[5] ..... H01Q 13/02

[52] U.S. Cl. ..... 343/756; 343/762; 343/786; 333/135

[58] Field of Search ..... 343/786, 762, 772, 776, 343/778, 756, 766; 333/21 A, 126, 135, 137

[56] References Cited

U.S. PATENT DOCUMENTS

| | | | |
|---|---|---|---|
| Re. 32,835 | 1/1989 | Howard | 343/21 A |
| 2,425,488 | 8/1947 | Peterson et al. | 343/786 |
| 2,454,766 | 11/1948 | Brillouin | 343/786 |
| 3,086,203 | 4/1963 | Hutchison | 343/786 |
| 3,109,144 | 10/1963 | Heninger et al. | 455/281 |
| 3,181,151 | 4/1965 | Clouser | 342/28 |
| 3,296,558 | 1/1967 | Bleackley | 333/21 A |
| 3,325,817 | 6/1967 | Ajioka et al. | 343/779 |
| 3,508,277 | 4/1970 | Ware et al. | 343/776 |
| 3,599,219 | 8/1971 | Hotlum et al. | 343/840 |
| 3,665,481 | 5/1972 | Low et al. | 343/762 |
| 3,720,947 | 3/1973 | Meyer et al. | 343/756 |
| 3,803,617 | 4/1974 | Fletcher et al. | 343/730 |
| 3,815,136 | 6/1974 | Rootsey | 343/786 |
| 3,815,139 | 6/1974 | Lewis et al. | 343/775 |
| 3,864,687 | 2/1975 | Walters et al. | 343/778 |
| 4,041,499 | 8/1977 | Liu et al. | 343/756 |

(List continued on next page.)

FOREIGN PATENT DOCUMENTS

| | | |
|---|---|---|
| 0215535 | 3/1987 | European Pat. Off. . |
| 0227121 | 7/1987 | European Pat. Off. . |

(List continued on next page.)

OTHER PUBLICATIONS

Koch et al., "Coaxial Radiator as Feed for Low Noise Paraboloid Antennas," Nachrichtentech, Z., vol. 22, pp. 166–173, 1969.

(List continued on next page.)

*Primary Examiner*—Michael C. Wimer

*Attorney, Agent, or Firm*—Pretty, Schroeder, Brueggemann & Clark

[57] ABSTRACT

A multiple-frequency feed assembly for an antenna system having two coaxial cavities, with a smaller, high-frequency cavity mounted coaxially within a larger, low-frequency cavity. A separate rotatable probe is mounted within each cavity. The smaller cavity is mounted within the larger cavity by any of several structures, such as a ring-shaped spider, a ring-shaped spacer in the form of a planar washer, or a harp extending rearwardly in the larger cavity. In all of the embodiments, a continuous, uninterrupted signal path is provided within the low-frequency cavity, around the high-frequency cavity, for conveying incident electromagnetic signals to the low-frequency probe mounted at the rear of the low-frequency cavity. In other embodiments, the feed assembly is adapted to detect incident electromagnetic signals in a third band of frequencies, lower than the low-frequency band, using a third probe located within the low-frequency cavity, immediately adjacent to the high-frequency cavity. This third probe preferably is aligned circumferentially with a conductor for conducting the detected high-frequency signal from the high-frequency probe to the exterior of the feed assembly.

19 Claims, 6 Drawing Sheets

U.S. PATENT DOCUMENTS

| | | | |
|---|---|---|---|
| 4,168,504 | 9/1979 | Davis | 343/786 |
| 4,414,516 | 11/1983 | Howard | 333/21 A |
| 4,504,836 | 3/1985 | Seavey | 343/761 |
| 4,528,528 | 7/1985 | Augustin | 333/21 A |
| 4,544,900 | 10/1985 | Howard | 333/21 A |
| 4,554,552 | 11/1985 | Alford et al. | 343/786 |
| 4,554,553 | 11/1985 | Grim | 343/786 |
| 4,574,258 | 3/1986 | Cloutier | 333/21 A |
| 4,679,009 | 7/1987 | Cloutier | 333/21 A |
| 4,740,795 | 4/1988 | Seavey | 343/786 |
| 4,783,665 | 11/1988 | Lier et al. | 343/786 |
| 4,785,306 | 11/1988 | Adams | 343/786 |
| 4,797,681 | 1/1989 | Kaplan et al. | 343/786 |
| 4,801,945 | 1/1989 | Luly | 343/786 |
| 4,819,005 | 4/1989 | Wilkes | 343/786 |
| 4,821,046 | 4/1989 | Wilkes | 343/786 |
| 4,829,313 | 5/1989 | Taggart | 343/756 |
| 4,829,315 | 5/1989 | Cookman | 343/779 |
| 4,853,657 | 8/1989 | Cruchon et al. | 333/137 |
| 4,862,187 | 8/1989 | Hom | 343/786 |
| 4,903,037 | 2/1990 | Mitchell et al. | 343/756 |
| 4,910,527 | 3/1990 | Dushane et al. | 343/786 |
| 5,003,321 | 3/1991 | Smith et al. | 343/786 |

FOREIGN PATENT DOCUMENTS

| | | |
|---|---|---|
| 0417356 | 3/1991 | European Pat. Off. . |
| 9102390 | 2/1991 | PCT Int'l Appl. . |
| 2166297 | 4/1986 | United Kingdom . |
| 2166298A | 4/1986 | United Kingdom . |

OTHER PUBLICATIONS

Jueken et al., "A Dual Frequency, Dual Polarized Feed for Radioastronomical Applications," *Nachrichtentech, Z.*, vol. 25, pp. 374–376, 1972.

Livingston, "Multifrequency Coaxial Cavity Apex Feeds," *Microwave Journal*, vol. 22, pp. 51–54, Oct. 1979.

IEEE Transactions on Antennas & Propagation, vol. AP≧34, No. 8, Aug. 1986 "Input Mismatch of $TE_{11}$-Feeds Mode Coaxial Waveguide," Trevor S. Bird, Grameme L. James & Stephen J. Skinner pp. 1030–1033.

IEEE Transactions on Microwave Theory & Techniquies, vol. MTT-35, No. 4, Apr., 1987, "Admittance of Irises in Coaxial & Circular Waveguides for $TE_{11}$ Mode Excitation," Graeme L. James, pp. 430–434.

FIG. 6
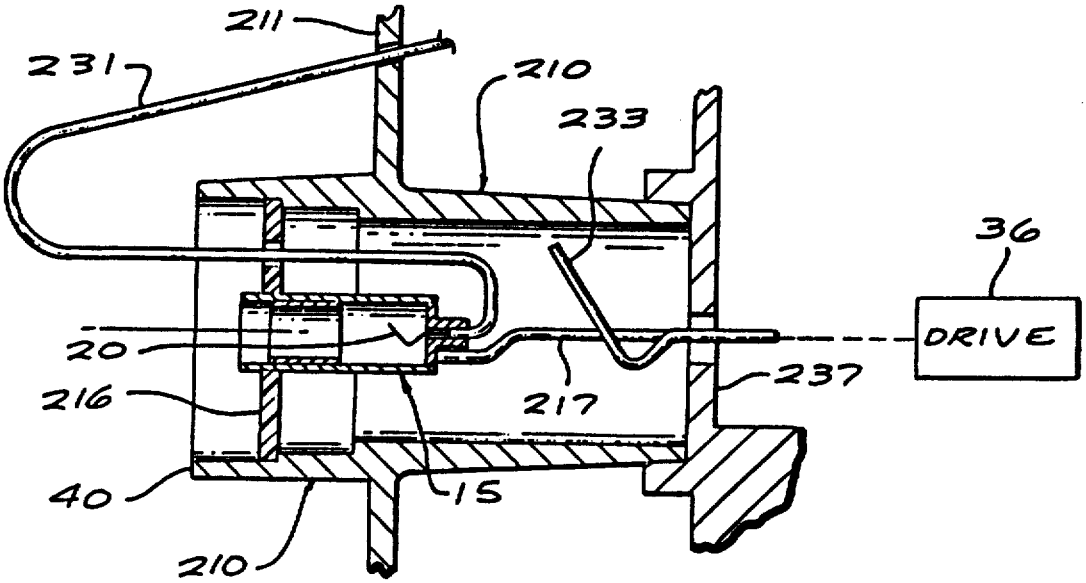
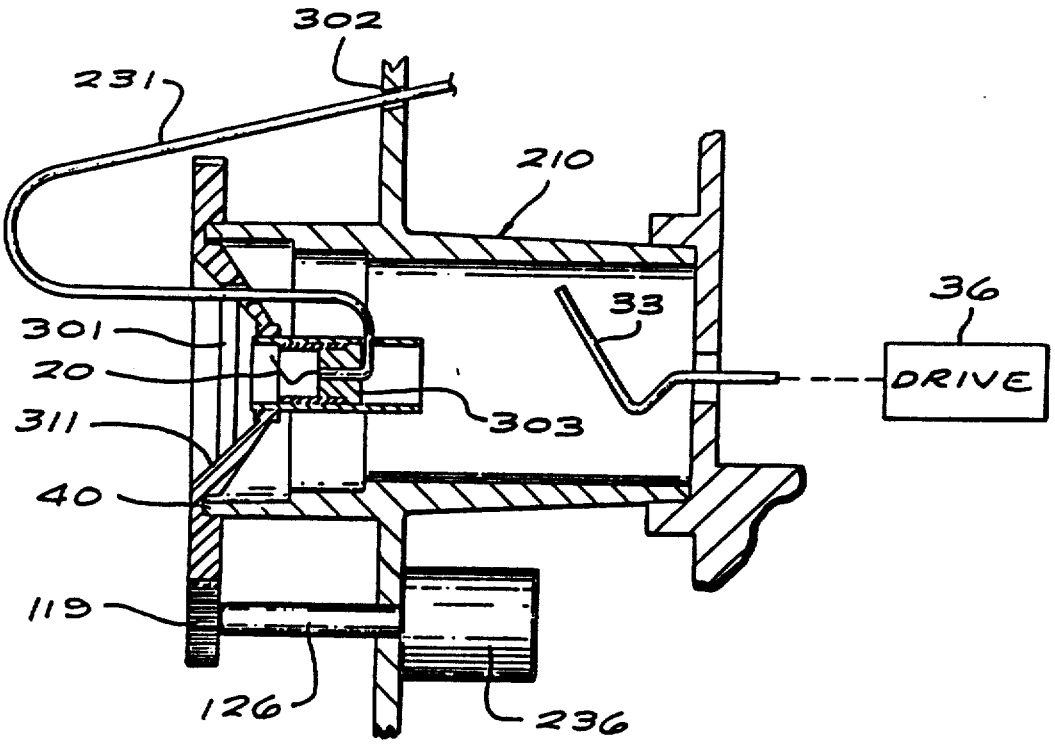
FIG. 7

MULTIPLE-FREQUENCY MICROWAVE FEED ASSEMBLY

CROSS REFERENCE TO RELATED APPLICATIONS

This is a continuation-in-part of application Ser. No. 07/405,548, filed Sep. 11, 1989, and now U.S. Pat. No. 5,107,274, which is a continuation application of U.S. Ser. No. 07/105,135, filed Oct. 2, 1987, and now U.S. Pat. No. 4,903,037.

BACKGROUND OF THE INVENTION

1. Field of the Invention

This invention relates generally to antenna feed assemblies and, more particularly, to antenna feed assemblies adapted to detect incident electromagnetic signals in two or more distinct frequency bands, simultaneously.

2. Description of the Related Art

With the recent growth in numbers of communication satellites in orbiting operation around the earth, the number of receiving stations has grown explosively. Each of these receiving stations requires an antenna capable of detecting signals at levels in the range of −120 dbm to −30 dbm, while rejecting terrestrial interference, and capable of polarization control. It is desirable for maximum utility that a single feed assembly exhibit the capability of operating simultaneously in two different frequency bands, e.g., the C band of 3.7 to 4.2 GHz and the Ku band of 11.7 to 12.2 GHz or the optional Ku band of 10.95 to 11.7 GHz. Simultaneous operation in yet a third frequency band, e.g., the S band of 2.544 to 2.655 GHz, also is desirable in many applications. A separate probe ordinarily must be provided for detecting signals in each band. This invention relates generally to microwave feed assemblies and, more particularly, to microwave feed assemblies that are adapted to detect signals in multiple distinct frequency bands.

It is desirable for multiple frequency feed assemblies to have the axes of their probes coaxial with a common reflector, to maximize the received signal strength at each frequency and to minimize unwanted side lobes. Coaxial mounting of dual frequency feeds without cross coupling and interference has not previously been effectively achieved. Studies have been made of input mismatches developed in TE11 mode coaxial feeds as well as the use of irises and their effects in coaxial waveguides. These studies, while helpful, have not given clear guidance for the design of an optimum dual frequency band coaxial feed assembly.

One attempt at a coaxial C- and Ku-band receiver antenna employs a plurality of wires surrounding a Ku-band assembly to bypass it as an obstruction and introduce the received signal into a C-band polarizer behind the Ku-band assembly. A common servo motor rotates both the Ku-band and C-band probes, to controllably adjust their polarities.

There is a need for a microwave feed assembly that can operate effectively to detect signals received from a common reflector in two or more frequency bands, with high signal strength and little unwanted side lobes. The present invention fulfills this need.

SUMMARY OF THE INVENTION

This invention is embodied in an improved coaxial feed assembly for receiving incident electromagnetic signals in two or more distinct frequency bands, with high signal strength and little undesired side lobes. Briefly, and in general terms, the feed assembly includes first and second antenna assemblies having aligned longitudinal axes. The first antenna assembly includes a feed assembly body having a boundary wall that defines a first waveguide cavity, with a first aperture at a forward end of the cavity, and with a first probe mounted in a rearward portion of the cavity, for receiving electromagnetic energy in a first band of frequencies. The second antenna assembly includes a second probe for receiving electromagnetic energy in a second band of frequencies, higher than the first band, along with a second signal conductor extending through a portion of the first waveguide cavity, for conducting energy received by the second probe to the exterior of the feed assembly body. Finally, means are provided for mounting the second antenna assembly coaxially within the first waveguide cavity, forwardly of the first probe and spaced from the boundary wall that defines the cavity. The cavity thereby provides a continuous, uninterrupted signal path, around the second antenna assembly, for conveying incident electromagnetic signals from the first aperture to the first probe.

More particularly, the boundary wall that defines the first waveguide cavity includes a circular, rear end wall and a cylindrical side wall such that the first waveguide cavity has a cylindrical shape. Similarly, the second antenna assembly includes a circular, rear end wall and a cylindrical side wall that define a second cylindrical waveguide cavity, in which is located the second probe. A dielectric spacer located radially between the cylindrical side walls of the first and second antenna assemblies positions the second antenna assembly coaxially in the first waveguide cavity.

In another feature of the invention, the feed assembly further includes means for rotating both the first probe and the second probe about the axial longitudinal axes of the first and second antenna assemblies, to change their respective polarities. A portion of the means for rotating the second probe extends through a portion of the first waveguide cavity, without adversely interfering with signal detection by the first probe. To facilitate rotation of the second probe, a slip joint is provided between the second probe and the second signal conductor, which is fixed relative to the feed assembly body.

In yet another feature of the invention, the feed assembly further includes a third antenna assembly having a third probe for receiving electromagnetic energy in a third preselected band of frequencies, lower than the first band of frequencies, along with means mounting the third probe within the first waveguide cavity, adjacent to the second antenna assembly. The third probe can include a single wire having an axial portion projecting forwardly within the first waveguide cavity, generally parallel with the coaxial longitudinal axis of the first and second antenna assemblies. A signal conductor carries the detected signals from the third probe to the exterior of the feed assembly body either radially outwardly through the cylindrical wall of the first waveguide cavity or rearwardly along the cylindrical wall to the rear wall of the first waveguide cavity. When the second signal conductor extends radially within the first waveguide cavity, the radial portion of the third signal conductor preferably is positioned parallel with, and axially forwardly of, that second conductor.

Other features and advantages of the present invention should become apparent from the following description of the preferred embodiments, taken in conjunction with the accompanying drawings, which illustrate, by way of example, the principles of the invention.

BRIEF DESCRIPTION OF THE DRAWINGS

FIG. 6 is a fragmentary side sectional view of a third embodiment of a dual-frequency feed assembly in accordance with the invention.

FIG. 7 is a fragmentary side sectional view of a fourth embodiment of a dual-frequency feed assembly in accordance with the invention.

DESCRIPTION OF THE PREFERRED EMBODIMENTS

Figure 1:
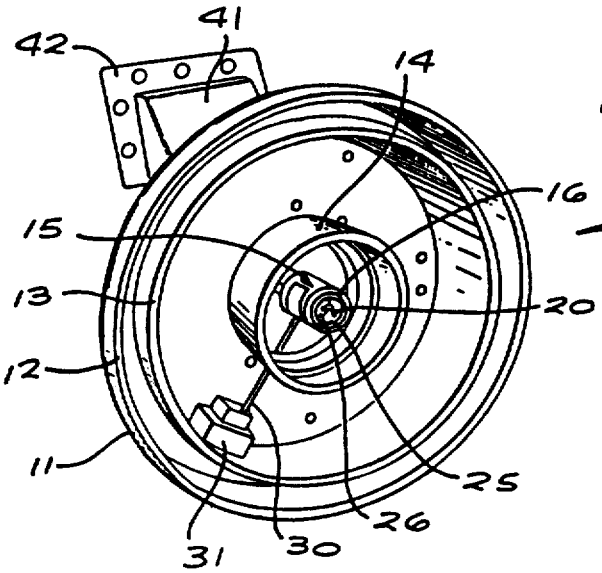
FIG. 1 is a perspective view of a first embodiment of a dual-frequency feed assembly in accordance with the invention.
Figure 4:
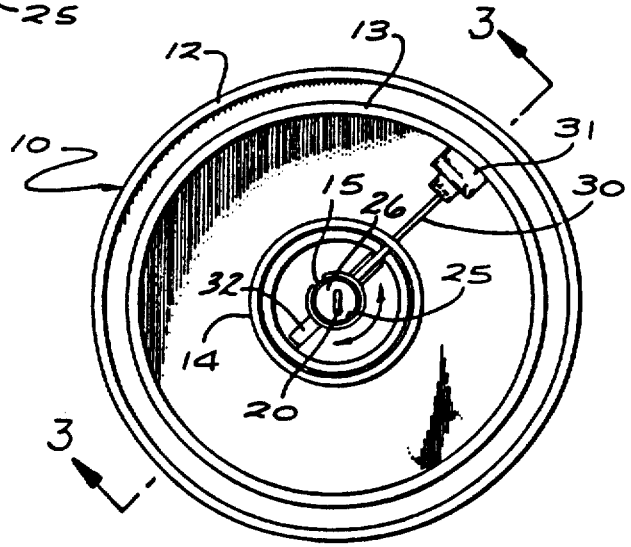
FIG. 4 is a front elevational view of the feed assembly of FIG. 1.

Now referring to FIGS. 1 and 4, a dual frequency feedhorn and polarizer assembly generally designated 10, may be seen ready to be installed in a reflector dish for receiving satellite communication signals. The assembly 10 includes a circular feedhorn 11 having a pair of outer annular rings 12 and 13, which encircle a C-band aperture defined by an annular tube 14.

Coaxially located within the tube 14 is a Ku-band feed assembly 15 that includes a sleeve 16 defining a Ku-band aperture and a rotatable probe 20 dimensioned to detect polarized signals in the plane of polarization of the probe 20. The sleeve 16 is part of a cup-shaped member 25 seen in FIG. 2, having a central aperture through with the probe 20 extends. A rear part of the probe 20 is insulatingly mounted on a coaxial probe support 26 at the rear of the cup-shaped member 25. The probe support 26 includes a side slot, unshown in the drawings, through which a coaxial or centerline feed conductor 30 passes between the probe 20 and a Ku-band waveguide adapter 31 mounted on the rear face of the feed body 11 and providing a Ku-band waveguide termination. The centerline feed conductor 30 extends into the waveguide adapter 31 to couple microwave energy detected by the Ku-band probe 20 to an external waveguide for transmission to a low-noise amplifier, which is unshown in the drawings but normally associated with feed assemblies, to amplify the detected signals.

The centerline feed conductor 30 enters the cavity behind the probe 20 via the slot described above and extends to the rear or bottom of the support 26 and there forms a U bend to a coaxial position at 17 (FIG. 2) extending toward the Ku-band aperture and joining the probe 20. The probe 20 itself is secured to the probe support member 26 and is free to rotate with the aperture defining sleeve 16. The sleeve 16 is held in a spring grip of an insulating extension 27A of a harp 32, best seen in FIG. 3. A similar ring-shaped extension 27B of the harp 32 encircles the support member 26.

Figure 3:
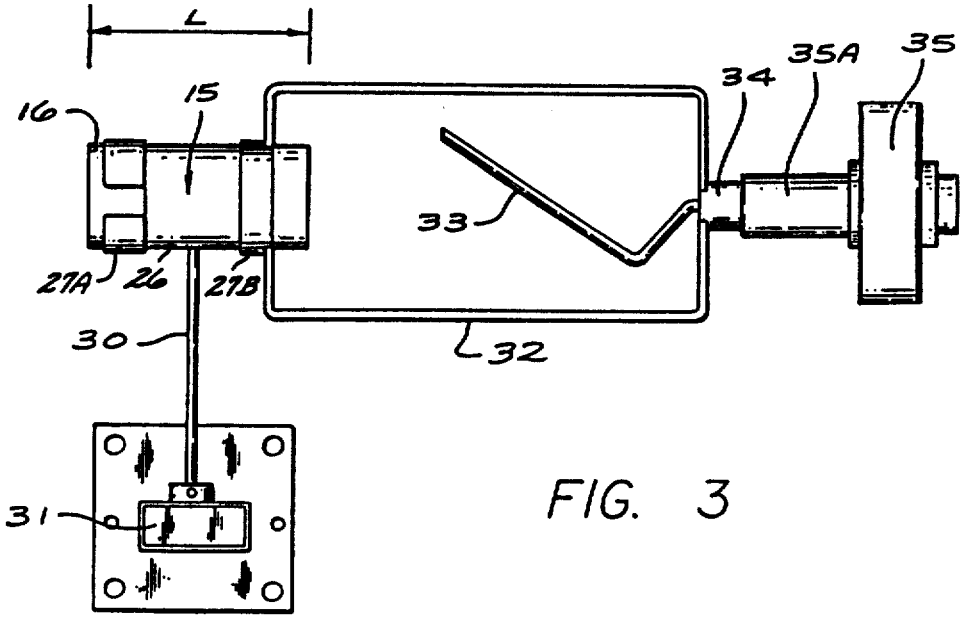
FIG. 3 is an enlarged side elevational view of the probe and probe holder portion of the feed assembly of FIG. 1.
Figure 2:
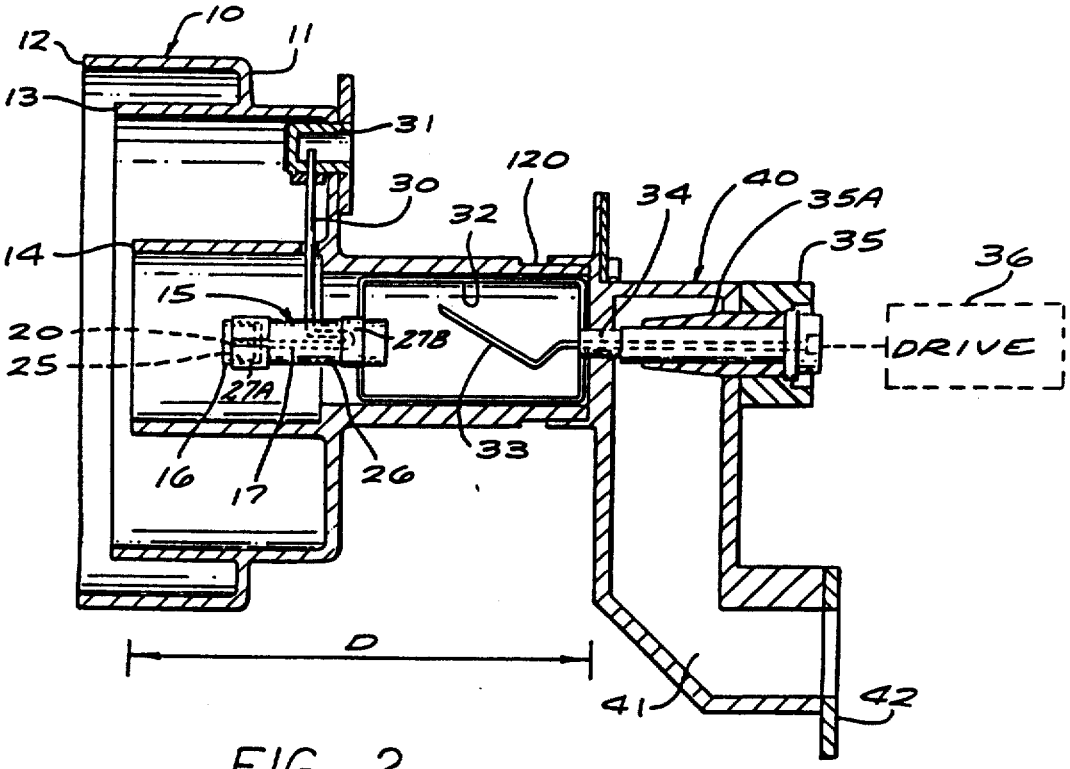
FIG. 2 is a sectional view of the feed assembly of FIG. 1.

The harp 32 encircles a C-band probe 33 of FIG. 3, which is located behind the Ku-band feed assembly 15 and therefore is not visible in FIG. 1 but is clearly shown in FIGS. 2 and 3. The C-band probe 33 and harp 32 are coupled via a shaft 34 and thermally-insulating bearing block 35, with its extension 35A to a servo motor 36 illustrated in FIG. 2 by a dashed line labeled DRIVE. The C-band probe 33 extends part way through the shaft 34 which itself extends through the termination of a C-band waveguide section 40 that includes a 90-degree bend 41 and a flange 42. The flange 42 is adapted to be coupled to additional waveguide sections to the low-noise amplifier.

As is apparent in FIGS. 2 and 3, the Ku-band probe 20 and the C-band probe 33 are both mechanically secured to the harp 32 and therefore are both capable of simultaneous movement under the control of the servo drive 36. Both the Ku-band and the C-band feed assemblies have centerline feeds to their respective probes 20 and 33, and the centerline feeds extend through respective waveguide sections 31 and 40 to couple Ku-band and C-band energy to their respective waveguides.

The Ku-band feed assembly 15 is located behind the C-band aperture, at a distance approximately ⅓ of the distance D from the aperture to the rear wall or bottom of the cup-like portion of the feedhorn which defines a C-band cavity. We have found empirically that the Ku-band feed assembly 15 has hardly noticeable detrimental effects upon signals received by the C-band probe 33. Likewise, the C-band probe 33, being located to the rear of the Ku-band probe 20, does not interfere with Ku-band signal detection.

Figure 5:
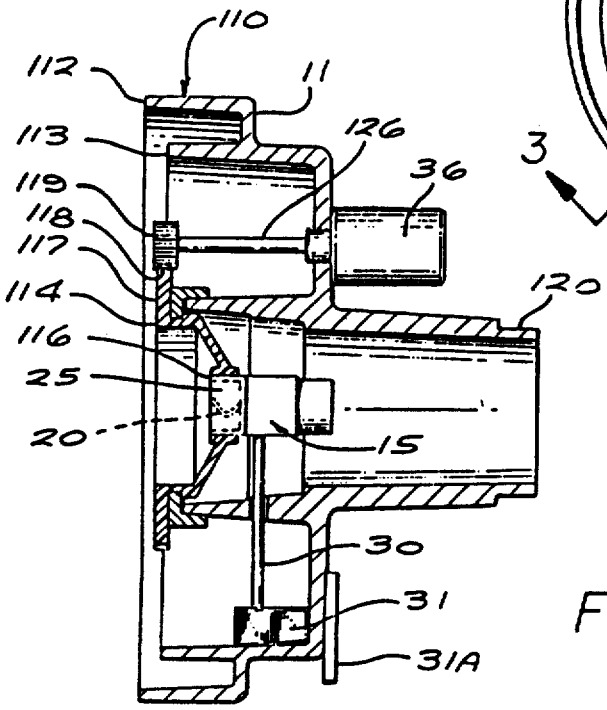
FIG. 5 is a side sectional view of a second embodiment of a dual-frequency feed assembly in accordance with the invention, this embodiment including an external gear drive system.

We have found that it is possible and practical to have independent drives for the Ku-band and C-band probes, with two servo motors both located behind the feedhorn, and particularly without interference by the polarizing drive assembly or the Ku-band assembly with the C-band probe signal detection. Such an arrangement is illustrated in FIG. 5.

Figure 9:
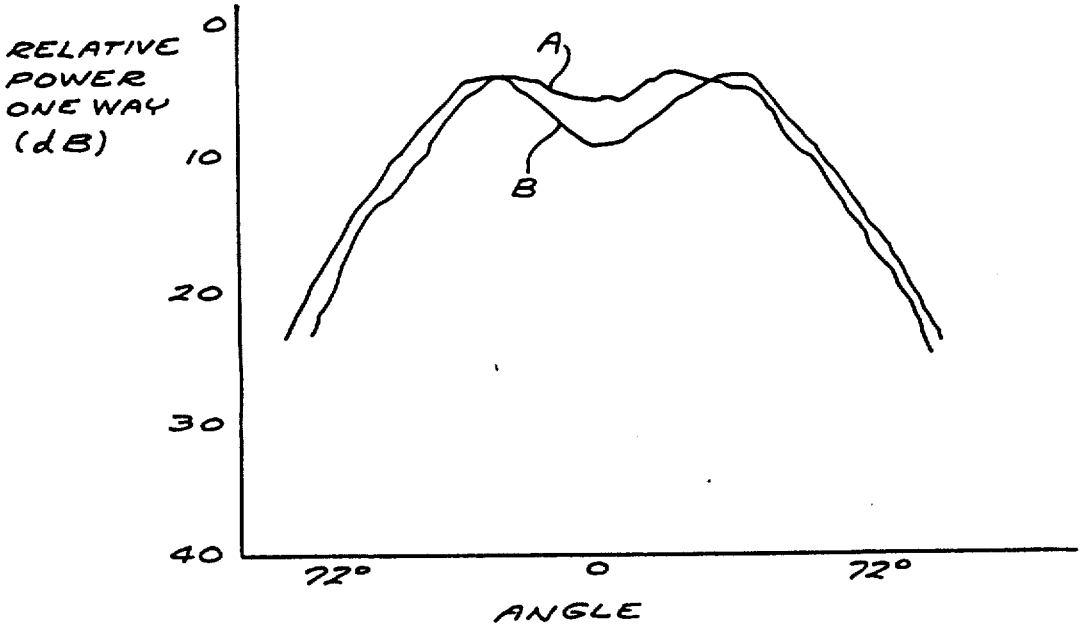
FIG. 9 is a graphical representation similar to FIG. 8, but for the feed assembly of the invention.

Normally, the presence of the second or Ku-band feed assembly within the first or C-band cavity would degrade the C-band operation. We have found, however, that by carefully selecting the dimensions and location of the second feed assembly, not only can degradation of C-band operation be avoided but, in certain respects, its operation can be enhanced. This enhancement is illustrated in FIG. 9 and discussed below.

First, the sleeve 16 of the Ku-band assembly 15 is dimensioned so that its diameter has a ratio to the diameter of the first or C-band cavity on the order of 0.3. In one specific embodiment, the nominal inside dimension of the C-band cavity was 2.4 inches and the diameter of the sleeve was 0.8 inch or 0.33 λg (C-band). When enlarged to 0.85 inch and 0.90 inch, the C-band performance was degraded. The minimum diameter of the Ku-band assembly is dictated by the required diameter of the Ku-band cavity, namely 0.74 inch or λg (Ku band), the waveguide wavelength. Therefore, 0.8 inch is the minimum practical diameter for the sleeve 16.

The length L of the Ku-band assembly 15 is dictated by several considerations. It must allow the coaxial conductor 30 to be aligned at the rear with the probe 20. This requires an L shape or modified U shape for the conductor 30. We have found that an overall length L of the Ku-band assembly 15 of 1.6 inches provides a structurally and electrically effective design.

Likewise, one would expect that inserting a conductor radially in the C-band cavity would virtually short circuit any signal entering the cavity. We have found, however, that the coaxial conductor 30 for the Ku-band probe 20 may extend from the Ku-band assembly 15 outwardly through the C-band cavity where it is located in the order of 0.6 μg, the waveguide wavelength at the mid band of the lower frequency, e.g., 3.9 GHz for C-band.

The presence of the Ku-band assembly 15 in the C-band cavity and its performance in the C-band is best illustrated by reference to FIGS. 8 and 9.

Figure 8:
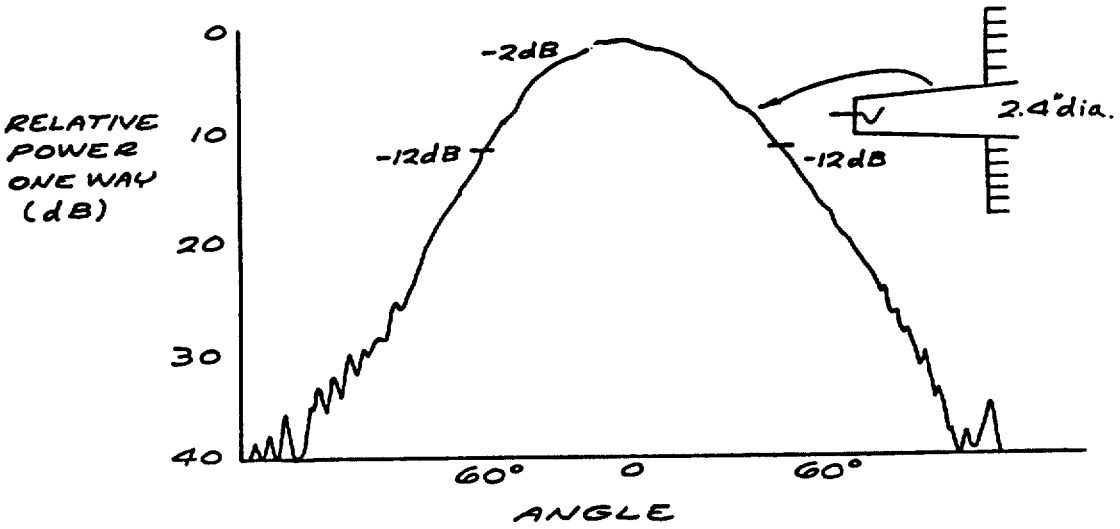
FIG. 8 is a graphical representation of the relative power/angle characteristic of a feed assembly having standard cavity and probe.

FIG. 8 illustrates a state-of-the-art single probe feed assembly as shown in the small sketch in FIG. 8. It shows a definite bell-shaped curve with noticeable side lobes. The peak at −2 db is located on the axis and the −12 db points are located approximately 60-degrees off axis. Optimum performance requires precise directional positioning of the feed relative to the dish.

By way of contrast, curve A of FIG. 9 shows the C-band characteristic of a coaxial assembly as illustrated in FIGS. 1-4. Instead of the peaked characteristic of FIG. 8, that of FIG. 9 is relatively insensitive to directional errors as much as 40 degrees. The average response between these angles is on the order of −5 db. The −10 db points are at ±72 degrees, in contrast with the typical characteristic of FIG. 8.

When the Ku-band assembly 15 is removed and the assembly operated at C band, the characteristic curve B shows a definite valley at 0 degrees orientation. Still the −10 db angles remain substantially unchanged. The relative response over ±36 degrees is on the order of −6 db, an acceptable level. With the Ku-band feed assembly 15 in place as illustrated in FIGS. 1-4, curve A of FIG. 9 is obtained with enhanced on axis response.

Now referring to FIG. 5, a second embodiment of the invention is illustrated in section. In FIG. 5, the same reference numerals are given to identical parts as used in FIGS. 1-4. In this case, a feed assembly 110 has an outer ring 112, an inner ring 113, and a lower or C-band aperture 114 in which the higher or Ku-band assembly 15 is located, similar to the assemblies of FIGS. 1-4. In this case, the assembly 15 and probe 20 are coaxially mounted in the aperture 114 by a microwave energy transparent spider 117 on a ring 118. The periphery of a front flange portion of the spider 117 constitutes a ring gear that engages the spur gear 119 on a shaft 126 of servo motor 36. The servo motor 36 is located on the rear face of the feed assembly 110 and out of the received energy path. The servo motor 36 may easily be protected from the weather by a cover, unshown in the drawing.

Similar to the embodiments of FIGS. 1-4, signals received by the Ku-band probe 20 are fed by the coaxial line 30 from the waveguide termination 31, which, similar to the embodiments of FIGS. 1-4, is available at an integral flange coupling 31A at the rear of the feed assembly, ready for engagement with the next section of the waveguide.

In the embodiment of FIG. 5, operation of the servo motor 36, driving shaft 126, and spur gear 119 allows rotation of a sleeve 116 that carries the probe 20. Unshown in FIG. 5 is the C-band or lower frequency probe and its own drive and waveguide. The rear of the feed assembly 110 of FIG. 5 is designed to receive on a rear step 120 the identical waveguide structure as illustrated in FIG. 2. Alternatively, the assembly of FIG. 5 may be operated as a single frequency adjustable polarization feed employing the same casting for the assembly as used in the embodiment of FIGS. 1-4, only adding the spider 117, the ring 118, the shaft 126, and the spur gear 119 to the standard servo motor 36. The two probes have independently controlled polarization in the embodiment of FIG. 5.

A third embodiment of the invention appears in the fragmentary diametrical sectional view of FIG. 6. A horn assembly 210 is basically of the same design as shown in FIG. 2, with certain exceptions described below. The high frequency or Ku-band assembly 15 is mounted within the C-band aperture 40, but in this case by a washer 216 and by an axial support 217 that carries on it a low frequency or C-band probe 233. A portion of the support 217 extends outside of a rear wall 237 to engage the drive 36. The outermost end of the support 217 is secured as by soldering to the Ku-band assembly 15. The probe 20 feeds a coaxial line 231, which extends forwardly through the washer 216 and then rearwardly through the horn body 211.

A fourth embodiment of the invention is illustrated in FIG. 7. This embodiment employs certain of the characteristics of the previous embodiments, in particular, the front drive of the embodiment of FIG. 5, the forward coaxial line of the Ku-band assembly of the embodiment of FIG. 6, and the dual independent drive capability of the embodiment of FIG. 5.

In the FIG. 7 embodiment, the basic horn structure 210 is of the type disclosed in FIG. 6, which includes the aperture 40 for the low frequency or C-band assembly and a 180-degree slot 301 in a spider 311 through which the fixed coaxial feed 231 extends to the front and then through an opening 302 in the feedhorn to the rear, where it joins a waveguide transition, unshown in FIG. 7 but similar to the waveguide termination 31 of FIGS. 2 and 3. The high frequency or Ku-band assembly 15 is insulatingly mounted with the probe 20 in a rear plug 303, in signal-conducting contact with the center conductor of the coaxial line 231. The plug 303 constitutes the rear of the probe holder, equivalent to probe support 26 of FIG. 1, and it engages the spider 311 to rotate the probe 20 as the spur gear 119 on the shaft 126 is driven by the servo motor 236.

Meanwhile, the low frequency or C-band probe 33, is driven directly by the drive motor 36. In this embodiment, the two probes 20 and 33 have their polarization independently controllable by their respective drive motors 236 and 36.

In each of the foregoing embodiments, coaxially mounted high- and low-band probes are provided. They are simultaneously controlled in polarization by a single servo motor, or they may be independently controlled by independent servo motors. In all of the embodiments, the high-band assembly is positioned coaxial with, and within, the cavity of the low-band assembly, spaced from the boundary wall that defines the low-band cavity but sized such that the low-band cavity provides a continuous, uninterrupted signal path around the high-band assembly, for conveying incident electromagnetic signals to the low-band probe at the rear of the low-band cavity. In all of the embodiments, efficient signal recovery is possible at both frequencies, and precise polarization control is possible without unwanted interference at the two bands. The structure is relatively simple and reliable as well.

Figure 10:
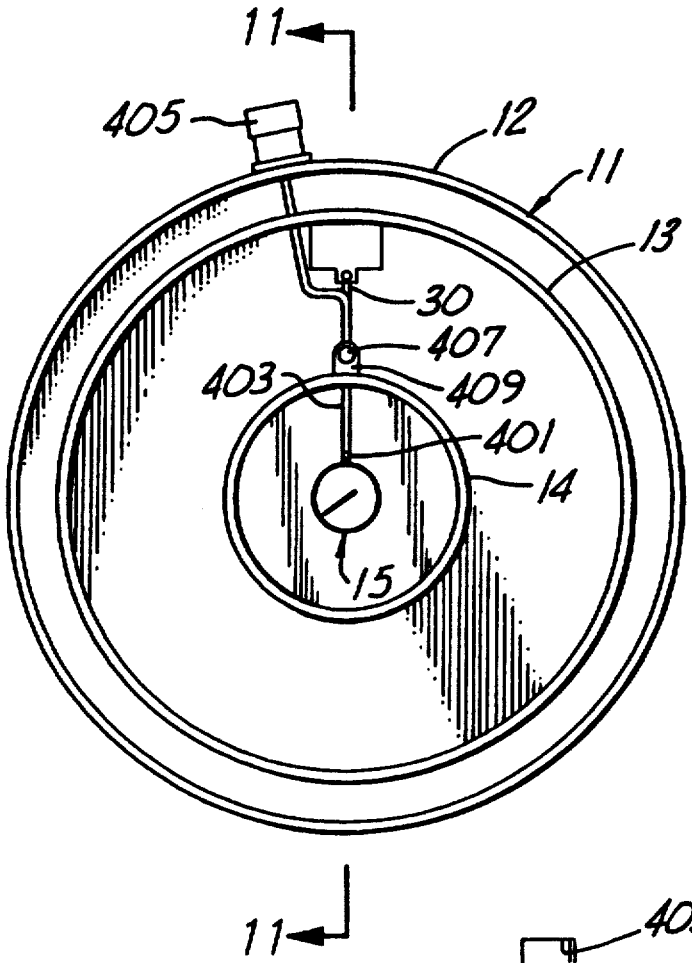
FIG. 10 is a front elevational view of a fifth embodiment of a feed assembly in accordance with the invention, this embodiment detecting electromagnetic signals in three distinct frequency bands.
Figure 11:
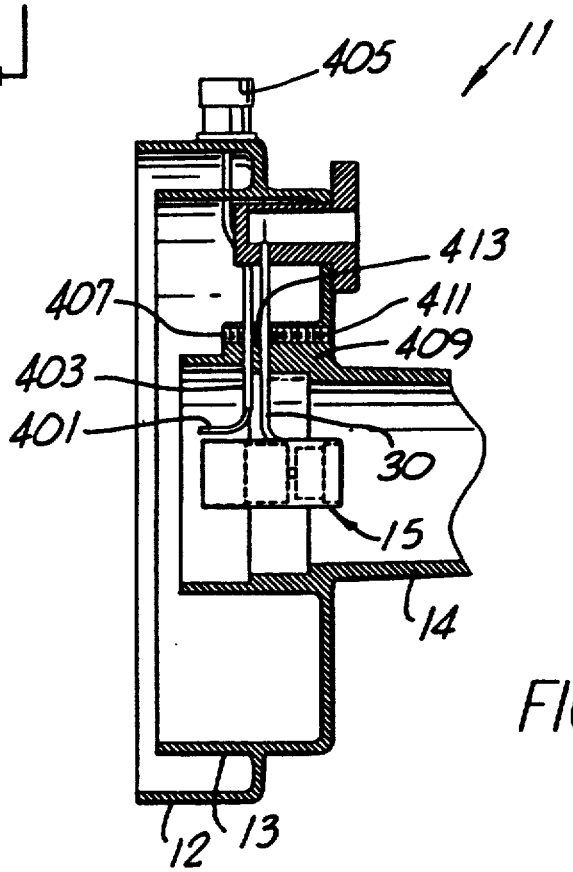
FIG. 11 is a fragmentary side sectional view of the feed assembly of FIG. 10, taken substantially in the direction of the arrows 11—11 in FIG. 10.

FIGS. 10 and 11 depict a fifth embodiment of a feed assembly in accordance with the invention. This embodiment is similar to the embodiment of FIGS. 1–4, except that it further includes an S-band probe 401 for detecting incident electromagnetic signals in yet another frequency band, i.e., S band, which extends from 2.544 to 2.655 GHz. Components included in the embodiment of FIGS. 10 and 11 that are common to the embodiment of FIGS. 1–4 are identified by the same reference numerals. For simplicity, the structure associated with the C-band probe and the structure associated with rotation of the C-band and Ku-band probes are omitted from the drawings.

The S-band probe 401 includes a single wire extending longitudinally within the C-band cavity, immediately adjacent to the Ku-band assembly 15. This probe conveniently is the exposed center conductor at the remote end of an S-band coaxial cable or signal conductor 403. The signal conductor 403 extends radially outwardly from the probe 401 through the C-band cavity and beyond to a standard coaxial cable connector 405 secured to the outermost annular ring 12 of the circular feedhorn 11. In particular, the signal conductor extends through holes formed in the annular tube 14 and the two annular rings 12 and 13. A set screw 407 is threadedly received in a threaded bore formed in a lateral extension 409 of the tube 14, to tighten against the signal conductor 403 and thereby secure the signal conductor and probe in place.

The S-band probe 401 and S-band signal conductor 403 preferably are aligned circumferently with the signal conductor 30 associated with Ku-band assembly 15. In particular, the S-band conductor 401 is arranged to be parallel with, and axially forward of, the radial portion of the Ku-band conductor 30. This relative orientation for the two conductors 401 and 30 provides minimal degradation of the electromagnetic signal detected by the C-band probe (not shown) at the rear of the C-band cavity.

The Ku-band conductor 30 extends radially from the Ku-band assembly 15 through the C-band cavity and through a hole in the tube 14 to reach a waveguide adapter 31 as was the case in the embodiment of FIGS. 1–4. A second set screw 411 threadedly received in a threaded bore formed in the same tube extension 409 as the threaded bore for the first set screw 407 and axially aligned with that threaded bore, secures the Ku-band conductor 30 in place. A rubber plug 413 preferably is positioned between the two conductors 401 and 30, in alignment with the two threaded bores and to provide adequate isolation between the two conductor.

Figure 12:
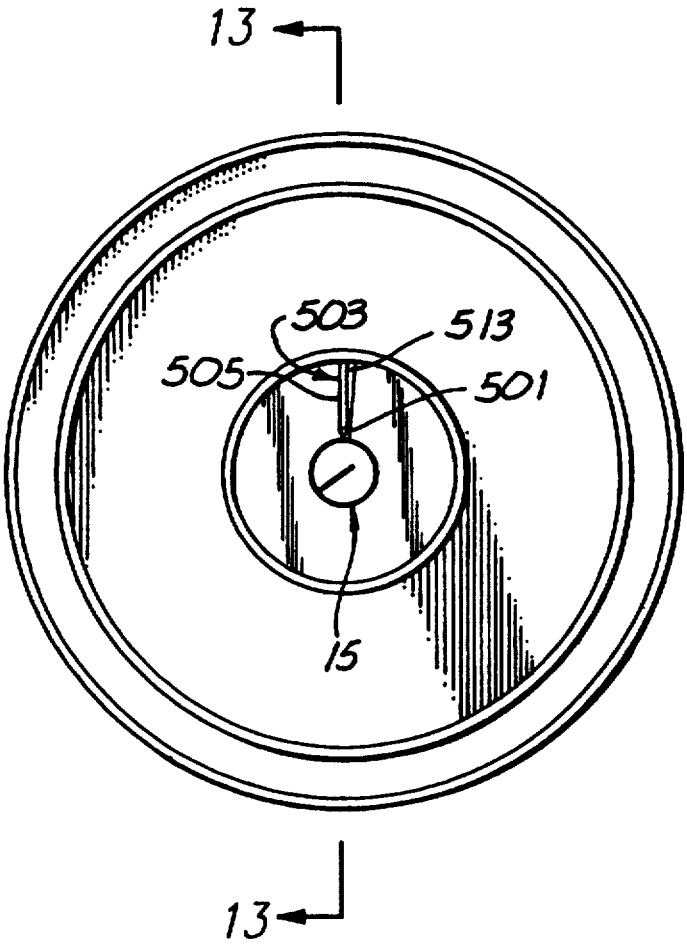
FIG. 12 is a front elevational view of a sixth embodiment of a feed assembly in accordance with the invention, this embodiment likewise detecting electromagnetic signals in three distinct frequency bands.
Figure 13:
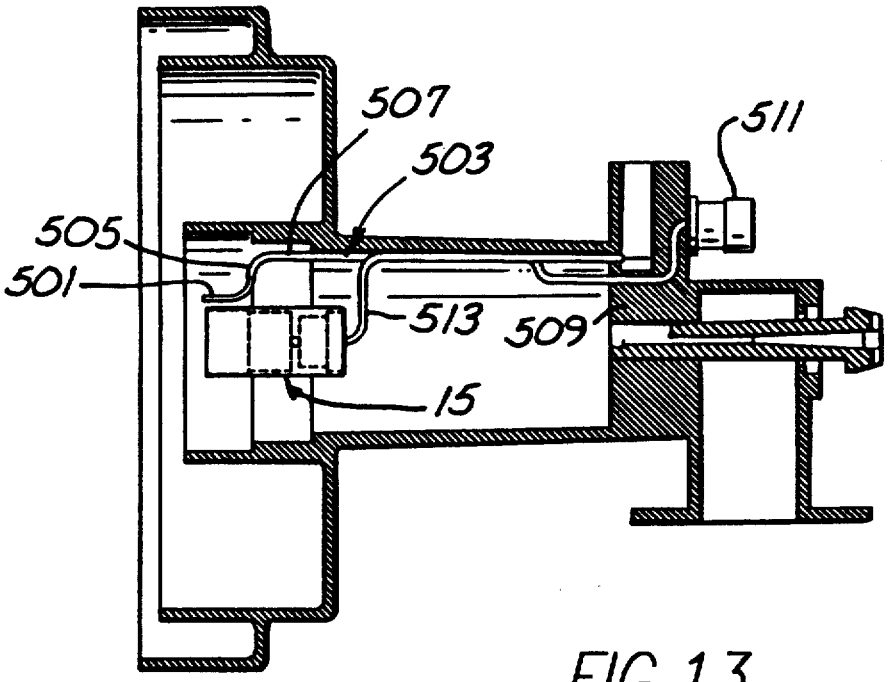
FIG. 13 is a side sectional view of the feed assembly of FIG. 12, taken substantially in the direction of the arrows 13—13 in FIG. 12.

FIGS. 12 and 13 depict a sixth embodiment of a feed assembly in accordance with the invention, this embodiment being similar functionally to the embodiment of FIGS. 10 and 11 in that it further includes an S-band probe 501 for detecting incident electromagnetic signals in the S-band of frequencies. Components of this embodiment that correspond to components in previously-described embodiments are identified by corresponding reference numerals. For simplicity, the structure associated with the C-band probe and the structure associate with rotation of the C-band probe and Ku-band probe are omitted from FIGS. 12 and 13.

In the feed assembly embodiment of FIGS. 12 and 13, the S-band probe 501 includes a single wire extending longitudinally within the C-band cavity, immediately adjacent to the Ku-band assembly 15, for detecting incident S-band signals. The probe 501 is a single wire that is the exposed center conductor at the remote end of an S-band coaxial cable or signal conductor 503. The signal conductor 503 includes a short radial portion 505 extending from the probe 501 radially outwardly to the wall defined by the annular tube 14, and further includes a longitudinal portion 507 extending rearwardly within the C-band cavity, immediately adjacent to the cavity wall. This longitudinal portion then extends through a hole formed in the rear wall 509 of the C-band cavity, to a standard coaxial cable connector 511 mounted on that rear wall. A signal conductor 513 for the Ku-band assembly 15 likewise extends longitudinally rearwardly within the C-band cavity, immediately adjacent to the longitudinal portion of the S-band conductor.

In this configuration, the S-band probe 501 and signal conductor 503 and the Ku-band assembly 15 and signal conductor 513 provide minimal disruption of the incident C-band electromagnetic signals being detected by the C-band probe (not shown).

It will be appreciated that additional embodiments of the invention could be constructed based on the embodiments of FIGS. 10–11 and 12–13. In particular, the S-band and Ku-band conductors need not both exit the C-ban cavity in the same location i.e., both in the cylindrical side wall (as in FIGS. 10 and 11) or both in the circular rear wall (as in FIGS. 12 and 13). Rather, the two conductors instead can exit the C-band cavity in separate locations. The S-band conductor could exit through the side wall while the Ku-band conductor exits through the rear wall, or conversely the S-band conductor could exit through the rear wall while the Ku-band conductor exits through the side wall. Regardless, however, the S-band and Ku-band conductors both are located in generally the same circumferential position within the C-band cavity.

Although the invention has been described in detail with reference only to the presently preferred embodiments, those of ordinary skill will appreciate that various modifications can be made without departing from the invention. Accordingly, the invention is defined only by the following claims.

We claim:

1. A coaxial feed assembly for receiving incident electromagnetic signals comprising:

a first antenna assembly having a longitudinal axis and including a feed assembly body having a boundary wall defining a first waveguide cavity through which incident electromagnetic energy can be conveyed, said boundary wall defining a first aperture at a forward end of said cavity and further defining a rearward end of said cavity, a first probe mounted within said first waveguide cavity, for receiving electromagnetic energy in a first preselected band of frequencies, and a support for supporting said first probe in a rearward portion of said first waveguide cavity;

a second antenna assembly having a longitudinal axis coaxial with the longitudinal axis of the first antenna assembly and receiving electromagnetic energy in a second preselected band of frequencies, higher than said first band of frequencies;

a mount for mounting said second antenna assembly coaxially within said first waveguide cavity, the second antenna assembly being mounted forwardly of said first probe and spaced from the boundary wall of said first waveguide cavity, said first waveguide cavity providing a continuous, uninterrupted signal path within said first waveguide cavity, around said second antenna assembly, for conveying incident electromagnetic energy from said first aperture to said first probe; and a two-conductor transmission line extending through a portion of said first waveguide cavity, for conducting electromagnetic energy received by said second antenna assembly to the exterior of said body.

2. A coaxial feed assembly as defined in claim 1, wherein:

said boundary wall defining said first waveguide cavity includes a circular, rear end wall and a cylindrical side wall, the first waveguide cavity thereby having a substantially cylindrical shape with a central axis that defines the longitudinal axis of the first antenna assembly; and said support for supporting said first probe extends through a central portion of said rear, circular end wall.

3. A coaxial feed assembly as defined in claim 2, wherein said second antenna assembly includes:

a body defining a second waveguide cavity of smaller dimension than said first waveguide cavity, said second waveguide cavity having a second aperture at a forward end thereof and being closed at a rearward end thereof;

a second probe for detecting electromagnetic energy in the second preselected band of frequencies; and a support for supporting said second probe in said second waveguide cavity.

4. A coaxial feed assembly as defined in claim 3, wherein:

said body defining said second waveguide cavity includes a circular, rear end wall and a cylindrical side wall, the second waveguide cavity thereby having a substantially cylindrical shape with a central axis that defines the longitudinal axis of the second antenna assembly; and said support for supporting said second probe extends through a central portion of said rear, circular end wall of said second waveguide cavity.

5. A coaxial feed assembly as defined in claim 4, wherein said second probe includes a single wire projecting forwardly into said second waveguide cavity.

6. A coaxial feed assembly as defined in claim 3, wherein said body defining said second waveguide cavity includes a rear, substantially planar face in facing relationship with said rear, circular end wall of said first waveguide cavity.

7. A coaxial feed assembly as defined in claim 3, wherein said mount for mounting said second antenna assembly includes a dielectric spacer located radially between said boundary wall and said body defining said second waveguide cavity.

8. A coaxial feed assembly as defined in claim 2, and further including a driver for rotating at least a portion of said second antenna assembly about the longitudinal axis of the second antenna assembly, to change the polarity of said second antenna assembly, said driver extending through a portion of said first waveguide cavity.

9. A coaxial feed assembly as defined in claim 1, wherein said mount for mounting said second antenna assembly includes a dielectric spacer located radially between said boundary wall and said second antenna assembly.

10. A coaxial feed assembly as defined in claim 1, and further including a driver for rotating said first probe and at least a portion of said second antenna assembly about the coaxial longitudinal axes of the first and second antenna assemblies, to change the polarities of the first probe and the second antenna assembly.

11. A coaxial, dual-frequency antenna feed assembly comprising:

a first antenna assembly having a longitudinal axis and including a horn having a boundary wall defining a first waveguide cavity, said boundary wall defining a first aperture at a forward end of said cavity and further defining a rearward end of said cavity, and a first probe for detecting electromagnetic energy in a first frequency band exposed to incident electromagnetic energy in said first aperture and positioned in a rearward portion of said first waveguide cavity, including a portion thereof coaxial with said longitudinal axis;

a first driver outside of said first waveguide cavity for rotating said first probe to change the polarization thereof;

a second antenna assembly having a longitudinal axis coaxial with the longitudinal axis of said first antenna assembly and positioned for detecting incident electromagnetic energy in a higher frequency band than electromagnetic energy detected by said first probe;

a positioner for positioning said second antenna assembly coaxially within said first waveguide cavity between said first aperture and said first probe, such that said second antenna assembly is spaced from the boundary wall defining said first waveguide cavity, said first waveguide cavity providing a continuous, uninterrupted signal path within said first waveguide cavity, around said second antenna assembly, for conveying incident electromagnetic energy from said first aperture to said first probe;

a two-conductor transmission line for transmitting electromagnetic energy detected by said second antenna assembly to the exterior of said first waveguide cavity; and a second driver for rotating at least a portion of said second antenna assembly to change the polarization thereof, said second driver extending through a portion of said first waveguide cavity.

12. A coaxial feed assembly as defined in claim 11, wherein:

said boundary wall defining said first waveguide cavity includes a rear, circular end wall and a cylindrical side wall, the first waveguide cavity thereby having a substantially cylindrical shape with a central axis that defines the longitudinal axis of the first antenna assembly; and said first probe extends through a central portion of said rear, circular end wall.

13. A coaxial feed assembly as defined in claim 12, wherein said second antenna assembly includes:

a body defining a second waveguide cavity of smaller dimension than said first waveguide cavity, said second waveguide cavity having a second aperture at a forward end thereof and being closed at a rearward end thereof;

a second probe for detecting electromagnetic energy in the second preselected band of frequencies; and a support for supporting said second probe in said second waveguide cavity.

14. A coaxial feed assembly as defined in claim 13, wherein:

said body defining said second waveguide cavity includes a rear, circular end wall and a cylindrical side wall, the second waveguide cavity thereby having a substantially cylindrical shape with a central axis that defines the longitudinal axis of the second antenna assembly; and said support for supporting said second probe extends through a central portion of said rear, circular end wall of said second waveguide cavity.

15. A coaxial feed assembly as defined in claim 14, wherein said second probe includes a single wire projecting forwardly into said second waveguide cavity.

16. A coaxial feed assembly as defined in claim 13, wherein said body defining said second waveguide cavity includes a rear, substantially planar face in facing relationship with said rear, circular end wall of said first waveguide cavity.

17. A coaxial feed assembly as defined in claim 13, wherein said positioner for positioning said second antenna assembly includes a dielectric spacer located radially between said boundary wall and said body defining said second waveguide cavity.

18. A coaxial feed assembly as defined in claim 11, wherein said positioner for positioning said second antenna assembly includes a dielectric spacer located radially between said boundary wall and said second antenna assembly.

19. A coaxial feed assembly for receiving incident electromagnetic signals, comprising:

a first antenna assembly having a longitudinal axis and including a feed assembly body having a boundary wall with a rear, circular end wall and a cylindrical side wall that define a first cylindrical waveguide cavity with a central axis that defines the longitudinal axis of the first antenna assembly, said boundary wall defining a first aperture at a forward end of said cavity, opposite said rear end wall, a first probe mounted within said first waveguide cavity, for receiving electromagnetic energy in a first preselected band of frequencies, and a support, extending through said rear end wall, for supporting said first probe in a rearward portion of said first waveguide cavity;

a second antenna assembly having a longitudinal axis coaxial with the longitudinal axis of the first antenna assembly and receiving electromagnetic energy in a second preselected band of frequencies, higher than said first band of frequencies;

a dielectric spacer for mounting said second antenna assembly coaxially within said first waveguide cavity, forwardly of said first probe and spaced from the boundary wall of said first waveguide cavity, said first waveguide cavity providing a continuous uninterrupted signal path within said first waveguide cavity, around said second antenna assembly, for conveying incident electromagnetic energy from said first aperture to said first probe;

a signal conductor extending through a portion of said first waveguide cavity, for conducting electromagnetic energy received by said second antenna assembly to the exterior of said body; and a drive for rotating said first probe and at least a portion of said second antenna assembly about the coaxial longitudinal axes of the first and second antenna assemblies, to change the polarities of the first probe and the second antenna assembly.

* * * * *

US005255003A

REEXAMINATION CERTIFICATE (2582nd)

United States Patent [19]

[11] B1 5,255,003

Mitchell et al.

[45] Certificate Issued May 16, 1995

[54] MULTIPLE-FREQUENCY MICROWAVE FEED ASSEMBLY

[75] Inventors: Rodney A. Mitchell, Tujunga; Gerry B. Blachley, Simi Valley, both of Calif.

[73] Assignee: Antenna Downlink, Inc., Las Vegas, Nev.

Reexamination Request:
No. 90/003,576, Sep. 19, 1994

Reexamination Certificate for:

| | |
|---|---|
| Patent No.: | **5,255,003** |
| Issued: | **Oct. 19, 1993** |
| Appl. No.: | **854,548** |
| Filed: | **Mar. 19, 1992** |

[ * ] Notice: The portion of the term of this patent subsequent to Feb. 20, 2007, has been disclaimed.

Related U.S. Application Data

[63] Continuation-in-part of Ser. No. 405,548, Sep. 11, 1989, Pat. No. 5,107,274, which is a continuation of Ser. No. 105,135, Oct. 2, 1987, Pat. No. 4,903,037.

[51] Int. Cl.[6] ..... H01Q 13/02

[52] U.S. Cl. ..... 343/756; 343/762; 343/786; 333/135

[58] Field of Search ..... 343/756, 762, 766, 772, 343/776, 778, 786; 333/21 A, 126, 135, 137

[56] References Cited

U.S. PATENT DOCUMENTS

| | | | |
|---|---|---|---|
| 2,820,965 | 1/1958 | Sichak | 343/756 |
| 4,282,527 | 8/1981 | Winderman et al. | 343/725 |
| 4,529,989 | 7/1985 | Dupressoir et al. | 343/756 |

FOREIGN PATENT DOCUMENTS 893476 7/1944 France .

OTHER PUBLICATIONS

PJ Wood, "Reflector Antenna Analysis And Design", Peter Peregrinus Ltd., 1980, p. 110.

*Primary Examiner*—Michael C. Wimer

[57] ABSTRACT

A multiple-frequency feed assembly for an antenna system having two coaxial cavities, with a smaller, high-frequency cavity mounted coaxially within a larger, low-frequency cavity. A separate rotatable probe is mounted within each cavity. The smaller cavity is mounted within the larger cavity by any of several structures, such as a ring-shaped spider, a ring-shaped spacer in the form of a planar washer, or a harp extending rearwardly in the larger cavity. In all of the embodiments, a continuous, uninterrupted signal path is provided within the low-frequency cavity, around the high-frequency cavity, for conveying incident electromagnetic signals to the low-frequeny probe mounted at the rear of the low-frequency cavity. In other embodiments, the feed assembly is adapted to detect incident electromagnetic signals in a third band of frequencies, lower than the low-frequency band, using a third probe located within the low-frequency cavity, immediately adjacent to the high-frequency cavity. This third probe preferably is aligned circumferentially with a conductor for conducting the detected high-frequency signal from the high-frequency probe to the exterior of the feed assembly.

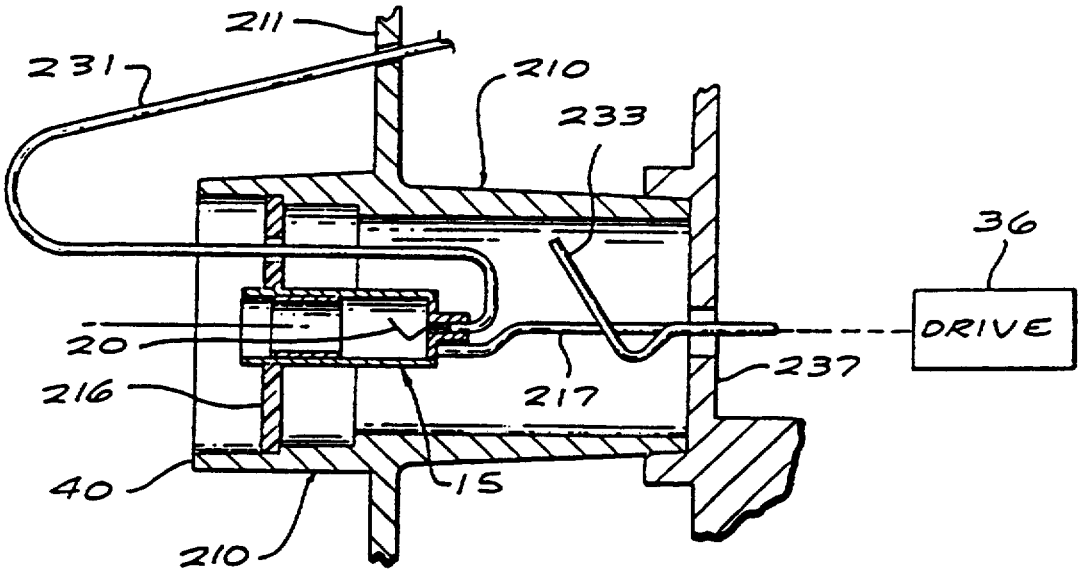

REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1–19 is confirmed.

* * * * *